US006910651B2

(12) United States Patent
Healey

(10) Patent No.: US 6,910,651 B2
(45) **Date of Patent: *Jun. 28, 2005**

(54) MATERIAL CRUSHER

(75) Inventor: John Healey, Las Vegas, NV (US)

(73) Assignee: HRW Limited Partnership, Las Vegas, NV (US)

( * ) Notice: Subject to any disclaimer, the term of this patent is extended or adjusted under 35 U.S.C. 154(b) by 94 days.

This patent is subject to a terminal disclaimer.

(21) Appl. No.: 10/269,504

(22) Filed: Oct. 11, 2002

(65) Prior Publication Data

US 2003/0071155 A1 Apr. 17, 2003

Related U.S. Application Data

(60) Provisional application No. 60/329,192, filed on Oct. 11, 2001.

(51) Int. Cl.[7] ..... B02C 1/08; B02C 15/10

(52) U.S. Cl. ..... 241/252; 241/253; 241/261.2; 241/296; 241/298

(58) Field of Search ..... 241/245, 251, 241/252, 253, 254, 257.1, 261.2, 261.3, 296, 297, 298

(56) References Cited

U.S. PATENT DOCUMENTS

| | | | | |
|---|---|---|---|---|
| 5,683,048 | A | * 11/1997 | Virving | 241/261.2 |
| 5,829,698 | A | * 11/1998 | Canada | 241/275 |
| 5,967,431 | A | * 10/1999 | Stafford et al. | 241/30 |
| 6,170,771 | B1 | * 1/2001 | Healey | 241/252 |
| 6,422,496 | B1 | * 7/2002 | Doelle | 241/261.2 |
| 6,502,774 | B1 | * 1/2003 | Johansson et al. | 241/37 |

* cited by examiner

*Primary Examiner*—Ed Tolan
(74) *Attorney, Agent, or Firm*—Robert Ryan Morishita; Anderson & Morishita, LLC

(57) ABSTRACT

A material crushing device including rotating rotors having first and second crushing surfaces which converge to a nip. One or both of the crushing surfaces may include projections and one or more of the crushing surfaces includes channels disposed at the nip for ejection of crushed material. The channels may be angled into the direction of rotation of the rotors to direct crushed material therethrough.

15 Claims, 15 Drawing Sheets

*FIG. 3B* *(Prior Art)*

*FIG. 4B* *(Prior Art)*

*FIG. 5B* *(Prior Art)*

ADDITIONAL 7:1 POCKET
9:1
A
B
C
500
502
506
508
510
512a
512b
514
516
106
1-3/16"
5/8"
2-13/16"
5/16"

ADDITIONAL 7:1 POCKET
9:1
1-3/16"
5/8"
2-13/16"
5/16"
700
702
106
708
712a
712b
710
714
716

MATERIAL CRUSHER

CROSS-REFERENCE TO RELATED APPLICATION

This application claims priority to prior filed U.S. Provisional Application Ser. No. 60/329,192 filed by Applicant herein on Oct. 11, 2001 and titled "Material Crusher."

FIELD OF THE INVENTION

The present invention relates to devices and methods for crushing materials such as rocks.

BACKGROUND OF THE INVENTION

It has been known to crush materials such as rock to produce, for example, gravel, sand, chips or to crush sea shells or other material which may be reduced to finer aggregate. Manufactured sand, that is sand produced by crushing as opposed to naturally occurring sand, is often specified to be used in manufacturing cement for road construction or the like since, unlike natural sand which has been weathered and the facets worn, manufactured sand has sharp facets which provide for binding in the cement product. Hence, manufacturing sand from crushing rock is an important industry to supply sand and, for that matter, manufactured aggregate for cement.

In addition to manufacturing sand, rocks are crushed to produce gravel and rock chips for use in aggregate and cement and, for example, decorative rock gravel. In the manufacture of gravel it is important to produce a consistent and predictable crushed product such that there is a minimum of non-conforming product, e.g., sand where chips are being manufactured, which must be screened. It would be advantageous to be able to substantially select the product to be produced (whether it be sand, aggregate or chips) and crush the rocks such that a substantial portion of the crushed material falls in the range of the desired product and that a minimum of the product is lost to nonconforming output.

It has also been known to crush frangible materials such as sea shells and the like.

One approach to rock crushing is as shown in Pamplin, U.S. Pat. No. 4,257,564 which has a rotating, planar and circular crushing jaw which operates with a conical jaw. The jaws are spaced to define an annular discharge opening. The conical crushing jaw is defined, in annular fashion, about an axially disposed feed tube which supports the rotating components associated with the conical jaw. Rock is fed axially down the axial tube and the jaws rotated which feeds the rock, through centrifugal force, between the jaws where they are crushed. The lower jaw is round and flat and coacts with the conical upper jaw to define a circular nip for crushing of rock. A drawback to this type of rock crusher is that upper jaw is conical which provides an irregular, non-planar crushing face and which, it turn, increases manufacture and replacement costs of the wear surfaces. The bottom jaw is flat and as a result does not cooperate to urge rock to the nip instead relying completely upon centrifugal force. There is no technique to positively feed and direct rock between the jaws.

In my prior patent, U.S. Pat. No. 6,170,771 issued Jan. 9, 2001 (the disclosure of which is hereby incorporated by reference), I described a new rock crusher having a polygonal crushing surface. It has been found that the polygonal crushing surface enhanced the crushing ability of the crusher.

It has been found that with material crushers of the type described above, product may tend to back-up into the crushing chamber. Product may choke at the the nip of the crusher preventing crushed material from being ejected from the crusher and decreasing throughput. Expanding the nip, while ejecting more product, also results in larger sized aggregate being ejected, which may not be desired.

It has further been found that, during crushing, wear patterns can develop on the crushing surfaces leading to premature failure or requiring premature replacement of crushing surface elements.

There is, therefore, a need for a material crusher which overcomes the problems of prior rock crushers by, among other features and advantages, configured wear and crushing surfaces for one of the top or bottom crushing rotors which is adapted to reduce and more evenly distribute wear, which provides for less expensive construction and replacement of wear surfaces and which provides a construction to reduce choking and provide for increased ejection of crushed product.

SUMMARY OF THE INVENTION

Toward this end, a device for crushing material is set forth which includes a housing with a feed port to receive the material to be crushed and a discharge opening for discharging the crushed product. A first rotor is disposed in the housing and has a first axis. The first rotor defines a first crushing surface. A second rotor is disposed in the housing and has a second axis. The second rotor includes a cavity to pass material and a face defining a second crushing surface adapted to be spaced from the first crushing surface and to define to define proximate the perimeter thereof a nip. Opposite the second crushing surface, the second rotor has a cover with at least one feed opening to admit material into the cavity. Means are provided for rotating the first and second rotors about their respective axises to centrifugally direct material between the nip for crushing thereof, and for discharging the crushed material discharged from the housing.

To increase throughput and enhance crushing, the one or both of the rotors at the nip includes channels sized for passing crushed material from the nip area of the rotors. For example, the grooves may be formed through the second crushing surface to eject crushed material in addition to material being ejected from the nip.

To further increase throughput and reduce wear, the first crushing surface, second crushing surface, or both the first and second crushing surfaces may include projections and ridges to agitate and distribute wear. Still further, channels in the first crushing surface, second crushing surface, or both crushing surfaces may be angled relative to the radius of the respective rotors to provide for ejection of material when the respective rotor is rotated in a clockwise or counterclockwise direction.

BRIEF DESCRIPTION OF THE DRAWINGS

These, and other features and advantages, will become appreciated as the same becomes better understood with reference to the specification, claims and drawings wherein:

FIG. 3B is a section view of the top of the second rotor according to prior art taken along line 3B—3B of FIG. 3A;

FIG. 4B is a section view of the spacer ring for the second rotor according to the prior art taken along line 4B—4B of FIG. 4A;

FIG. 5B is a section view of the crushing ring for the second rotor according to the prior art taken along line 5B—5B of FIG. 5A;

DESCRIPTION

Figure 1:
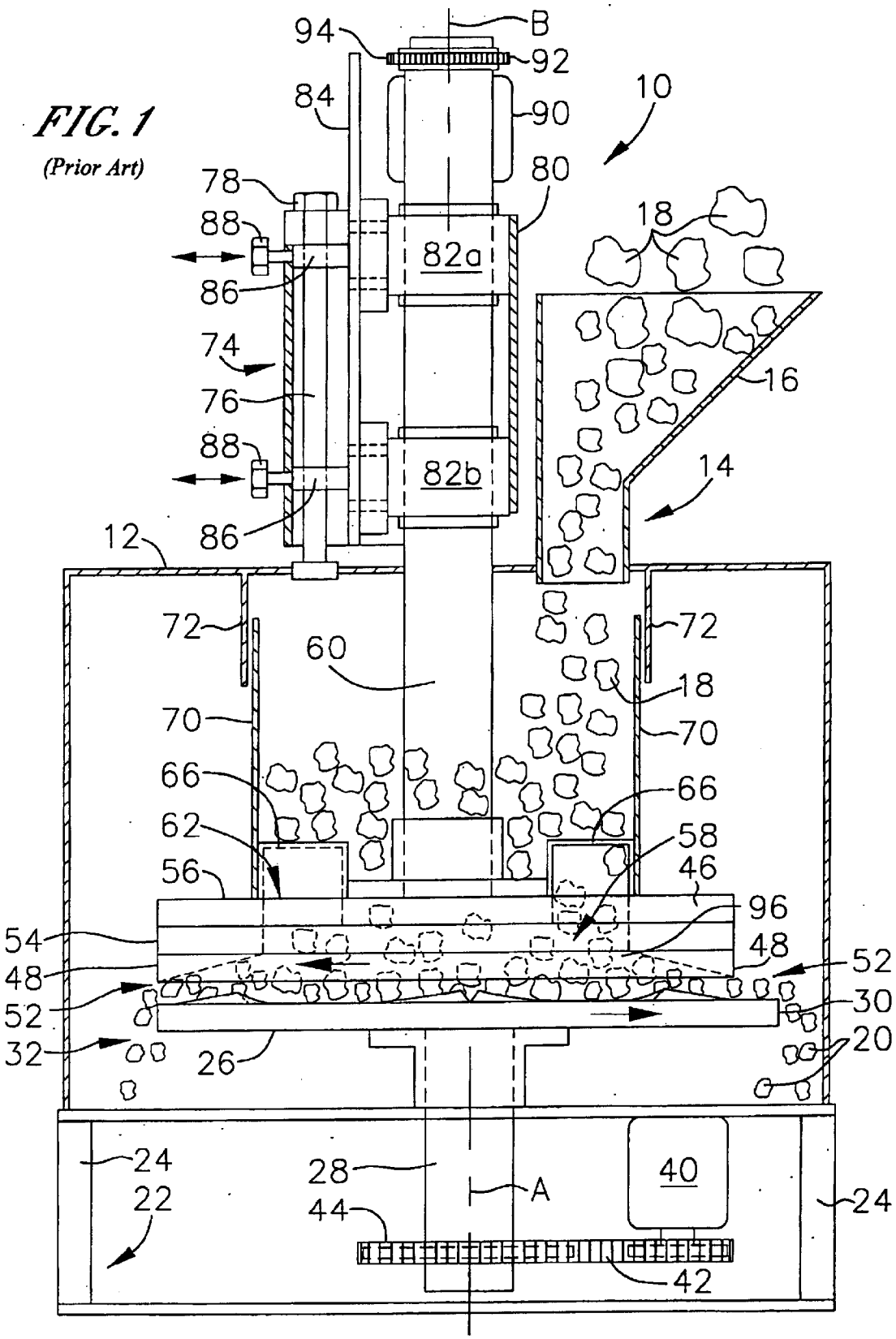
FIG. 1 (Prior Art)
FIG. 1 is a partial section view of a device according to the prior art illustrating the feed of rocks therethrough.
Figure 2:
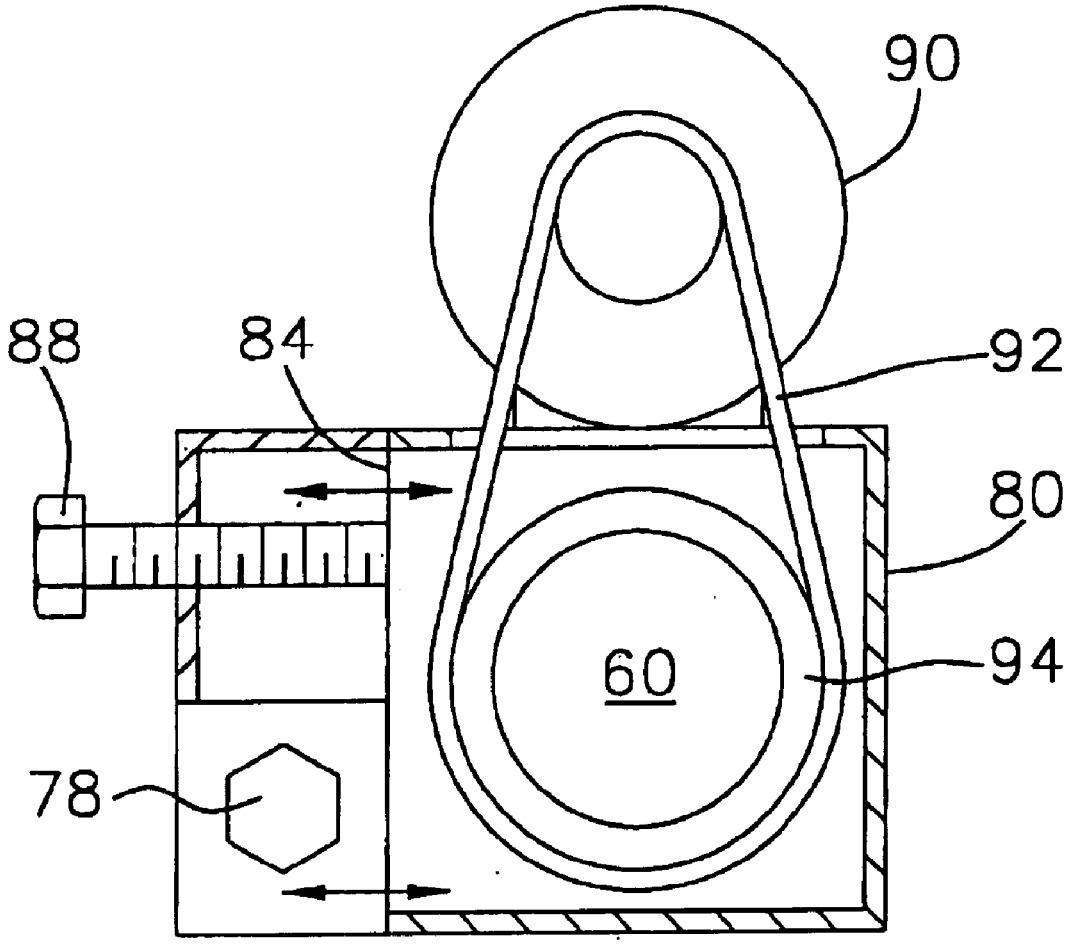
FIG. 2 (Prior Art)
FIG. 2 is a top view of a portion of the device of FIG. 1 illustrating the adjustment of the relative positions for the crushing surfaces according to the prior art.

Turning to the drawings, FIG. 1 shows a device 10 according to the prior art. The device 10 includes a closed housing 12 adapted to contain the components as hereinafter described. At the top the housing 12 there is a feed port 14 which may have a funnel 16 for feeding of rocks 18 into the housing 12 for crushing thereof. At the lower portion of the housing is a discharge (not shown) from which the crushed material 20 falls for collection thereof.

The housing 12 is supported above the ground on a stand 22 including a plurality of legs 24 to raise the housing 12 above the ground for collection of the crushed material 20 from the device 10.

Figure 6:
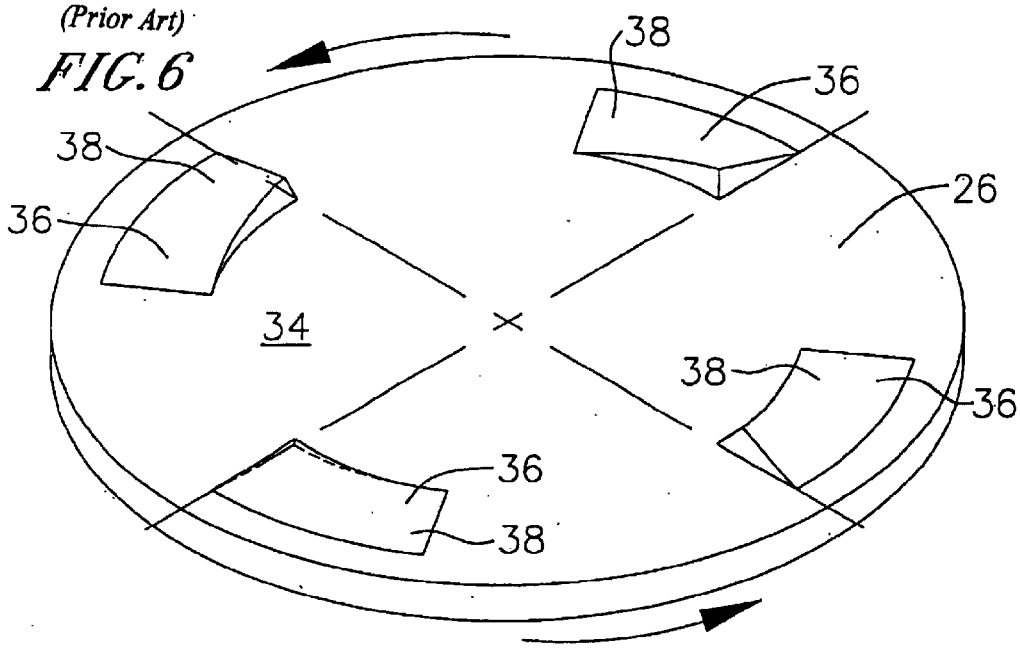
(Prior Art) FIG. 6
FIG. 6 is a top perspective view of the first rotor crushing surface according to the prior art.
Figure 7:
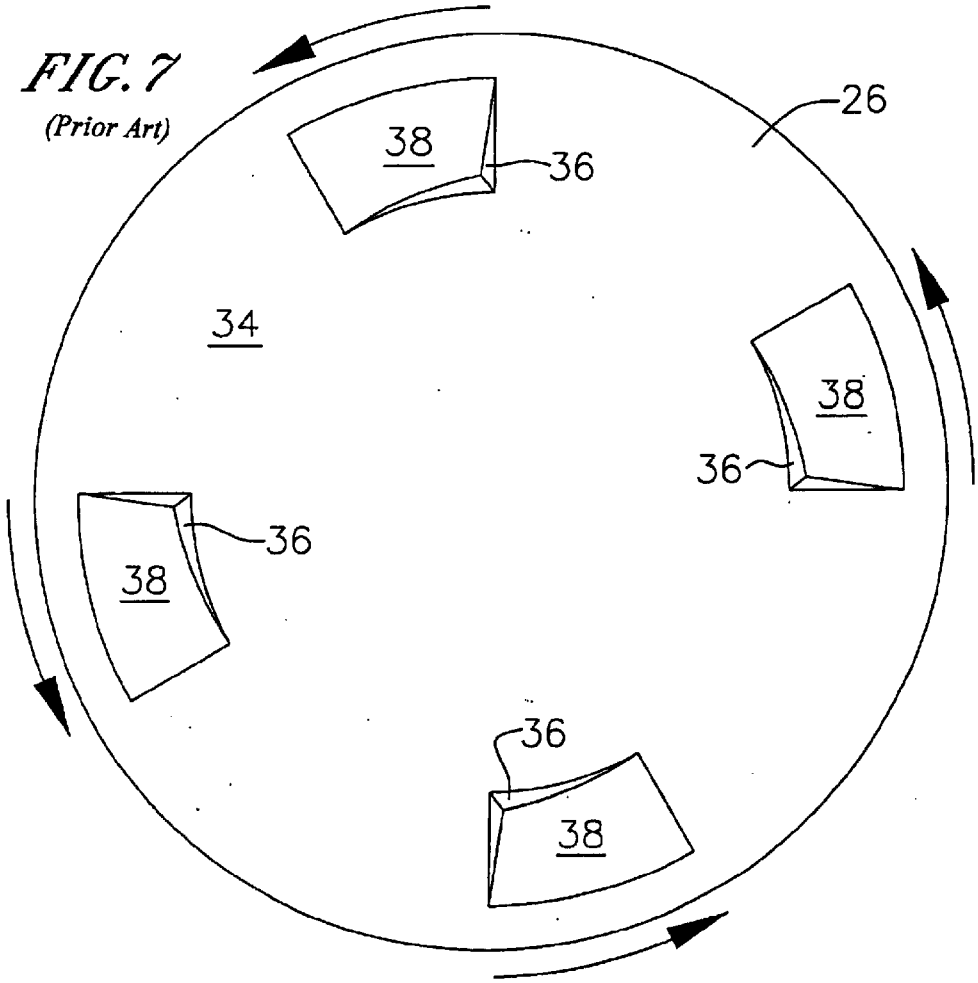
FIG. 7 (Prior Art)
FIG. 7 is a plan view of the top surface of first rotor according to the prior art.

With reference to FIGS. 1, 6 and 7, the device 10 includes a first rotor 26 mounted on a shaft 28 which is journaled for rotation about an axis A. Preferably, the housing 12 is cylindrical and is arranged coaxial with the shaft 28. The first rotor 26 is circular, flat having a diameter to locate the perimeter 30 inboard of the housing 12 to provide an annular space 32 for the crushed material 20 to fall to the bottom of the housing 12 to be discharged therefrom. As shown in the drawings, the first rotor 26 has a generally planar first crushing surface 34 against which the rocks 18 are crushed in a manner to be described below. As illustrated in FIGS. 6 and 7, the first crushing surface 34 may include a plurality of shoes 36 tapered to define a directing surface 38 angled into the direction of rotation of the first rotor 26 and sloping outwardly and downwardly to merge with the planar first crushing surface 34. The shoes 36, and more particularly the directing surfaces 38 thereof, are adapted, when the first rotor 26 is rotated in a counter-clockwise direction as shown in FIGS. 6 and 7, to engage and urge the rocks outwardly in combination with centrifugal forces imposed on the rocks as hereinafter described. The first crushing surface 34 may be simply flat as well.

Returning to FIG. 1, the first rotor 26 is journaled to the housing 12 for rotation about axis A. To drive the first rotor 26, a first motor 40 is provided and is coupled by drive means such as a chain 42 meshing with a sprocket 44 to rotate the shaft 28 of the first rotor 26 about axis A. Preferably the drive means encompassed by the first motor 40, chain 42 and sprocket 44 rotates the shaft 28 at approximately 1,760 rpm. However, the first motor 40 could be variable speed in order to alter the speed of rotation of the first rotor. Further, depending upon the diameter of the rotors, the speed may be increased or decreased.

To cooperate with the first rotor 26, the device 10 includes a second rotor 46 having an annular, conical ring 48 defining a second crushing surface 50 (FIG. 5B) adapted to be spaced from the first crushing surface 34 to define a nip 52 for crushing of the rocks 18.

Figure 4A:
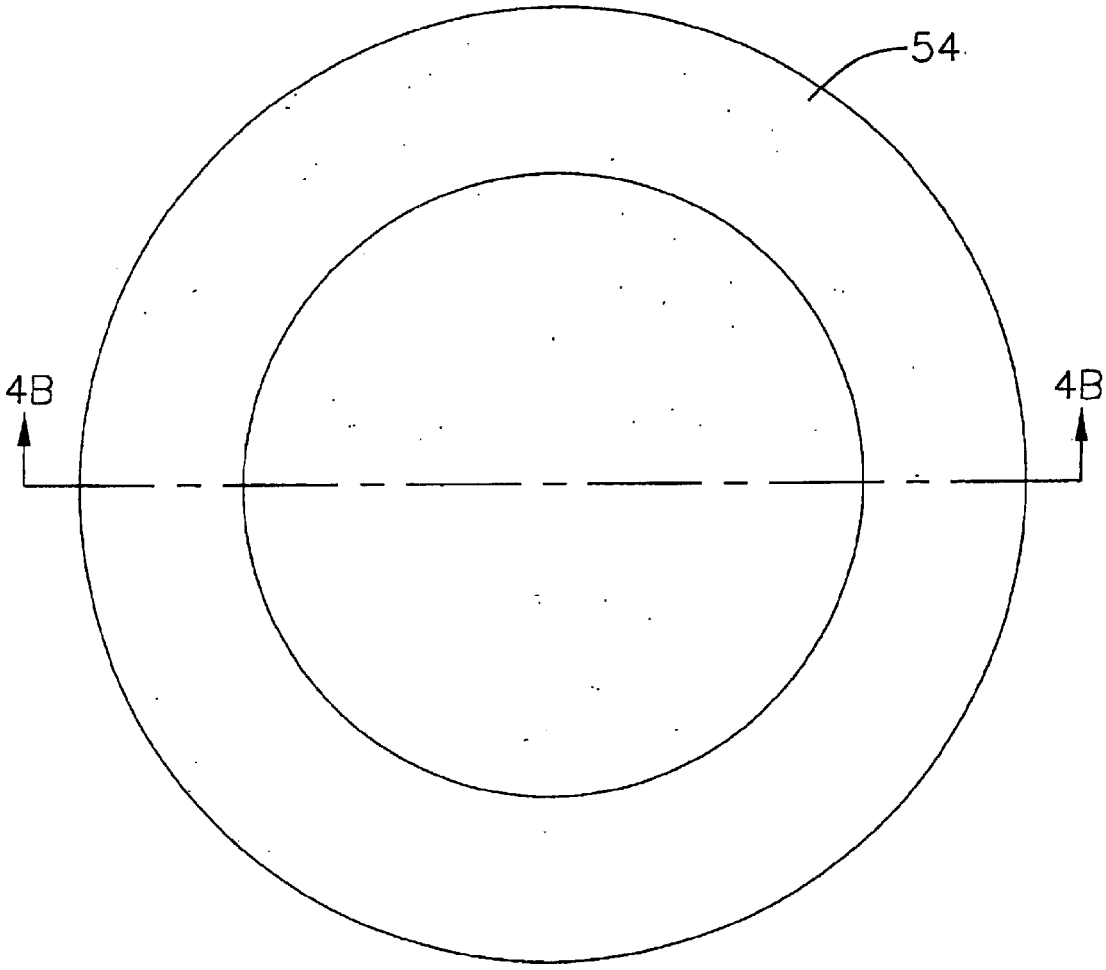
FIG. 4A (Prior Art)
FIG. 4A is a plan view of a spacer ring according to the prior art for the second rotor.
Figure 4A:
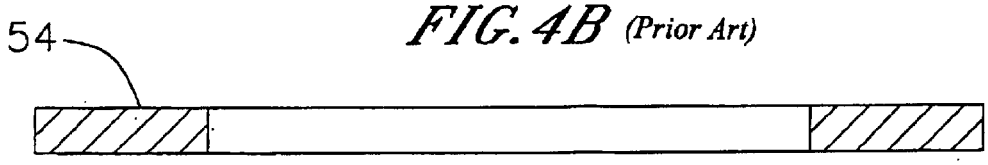
FIG. 4A (Prior Art)
Figure 5A:
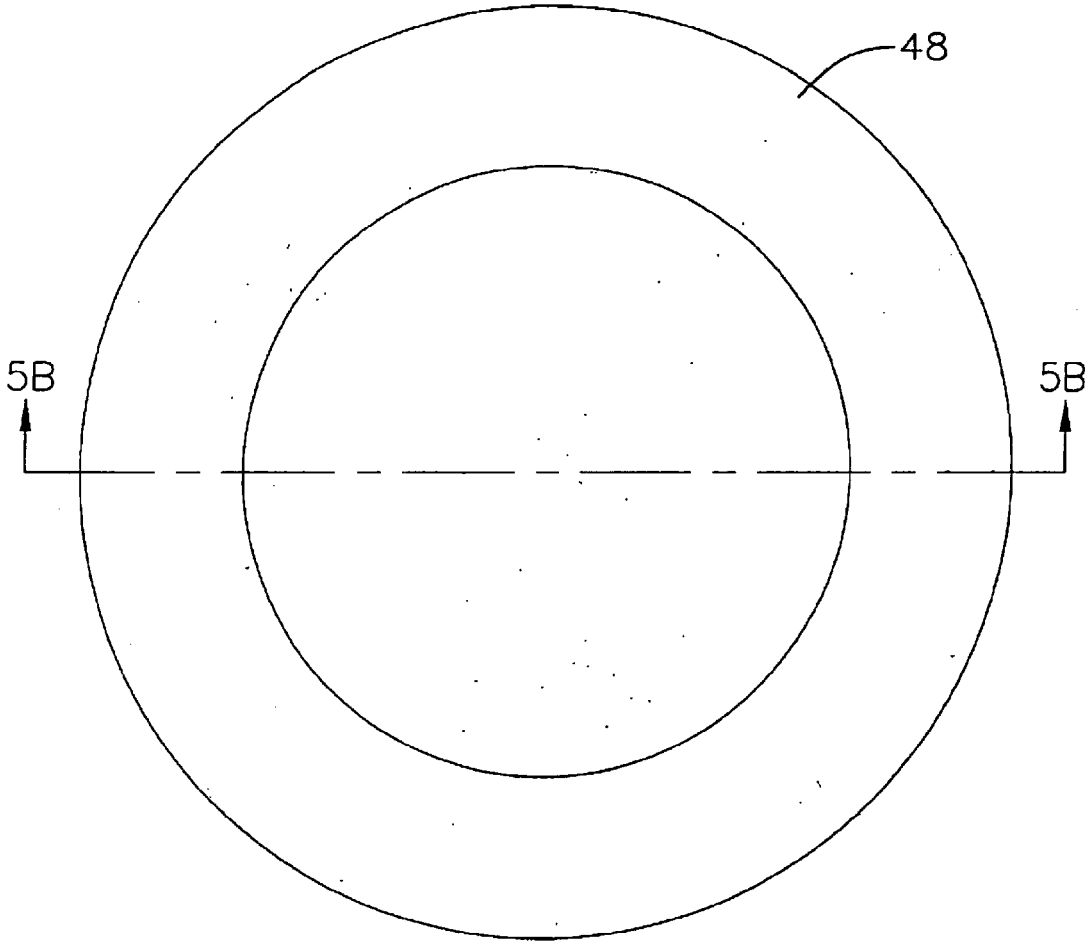
FIG. 5A (Prior Art)
FIG. 5A is a plan view of the crushing ring for the second rotor according to the prior art.
Figure 5A:
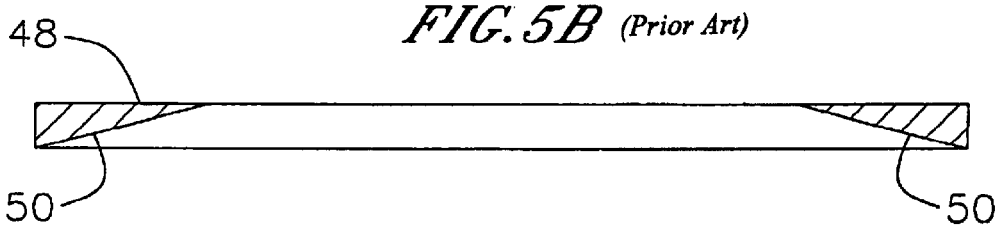
FIG. 5A (Prior Art)

The second rotor 46, as shown in FIGS. 5A, 5B, is defined, in part, by an annular conical ring 48 which defines a conical second crushing surface 50 adapted to cooperate with the first crushing surface 34 to define the crushing nip 52. The annular conical ring 48 including the second crushing surface 50 is coupled to an annular spacing ring 54 as shown in FIGS. 1, 4A and 4B which is in turn secured to a generally closed, circular top plate 56 shown in FIGS. 3A, 3B. The outside perimeters of the annular conical ring 48, spacing ring and top plate 56 are of equal outside diameter and are concentrically aligned along a second axis B. The annular space defined by the spacing ring 54 and annular concentric ring 48 and as covered by the top plate 56 defines a crushing chamber 58 adapted to receive rocks 18 for crushing thereof.

To provide for rotation, the second rotor 46 includes a shaft 60 aligned with the second axis B and secured at one end to the top plate 56, the other end extending from the housing 12 as shown in FIG. 1. As will be described below, the shaft 60 is adapted to be rotated about the second axis B and can be vertically and horizontally displaced, with reference to FIG. 1, to alter the size of the nip 52 and provide, if desired, an offset between the first and second axises A and B.

Figure 3A:
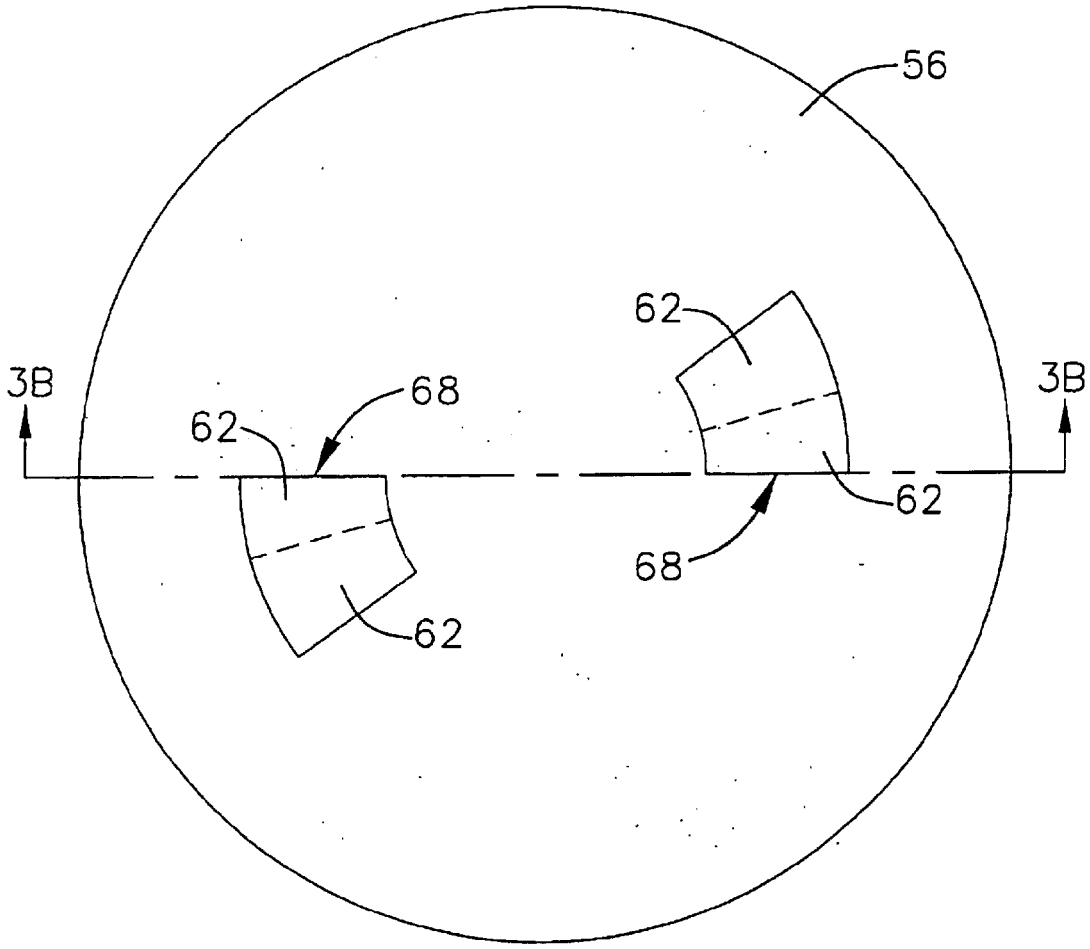
FIG. 3A (Prior Art)
FIG. 3A is a top view of the second rotor according to the prior art.
Figure 3A:
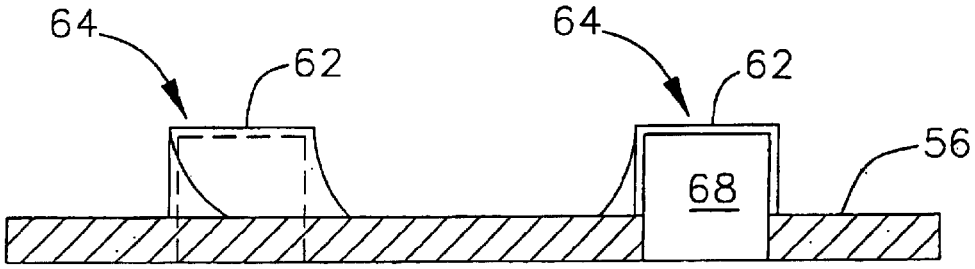
FIG. 3A (Prior Art)

With reference to FIGS. 1, 3A and 3B, the top plate 56 includes one or more feed openings 62 disposed radially from the second axis B and is best shown in FIG. 1 from the shaft 60. Rocks 18 fed into the feed port 14 are in turn admitted through the feed openings 62 into the conical crushing chamber 58 for crushing thereof. While the feed openings 62 may simply be openings in the top plate 56, the top plate 56 may include a plurality of shoulders 64 each adapted to urge rocks 18 through the feed openings 62 in response to rotation of the second rotor 56. Accordingly, the shoulders 64 may be embodied as tapered scoops 66 each having a mouth 68 directed into the direction of rotation of the second rotor 46, the scoops 66 tapering from the mouth 68 to the feed opening 62. Accordingly, and in response to rotation of the second rotor 46, the scoops 66 direct rocks into their respective feed openings 62 and therethrough into the crushing chamber 58.

Also secured to the top plate 56 is a cylindrical bin 70 aligned coaxially with the second axis B and adapted to rotate with the second rotor 46. Thus it can be appreciated from FIG. 1, rocks 18 fed into the feed port 14 fall into the bin 70 as it rotates with the second rotor 46 whereupon the rocks 18 are fed through the feed openings 62 into the crushing chamber 58.

To cooperate with the bin 70 to confine the rocks therein, the housing 12 includes a fixed, cylindrical skirt 72 projecting downwardly to overlap the top of the bin 70 to prevent rocks 18 from being ejected from the rotating bin 70.

To support the second rotor 46 for rotation thereof, the device 10 includes a support carriage 74 movably mounted to the housing 12. To support the support carriage 74, the housing mounts one or more pillars 76 in a position to upstand from the housing 12. The support carriage 76 is, in turn, movably mounted to the pillars 76 for vertical motion along the second axis B and for motion transverse to the second axis B. Each of the pillars 76 is internally threaded to receive a vertical adjustment bolt 78 which in turn mounts the support carriage 76. Accordingly, rotation of the vertical adjustment bolt 78 displaces the support carriage 74 and the shaft 60 journaled thereby vertically which in turn adjusts the spacing of the nip 52.

The support carriage 74 has a frame 80 which is in turn mounted to the vertical adjustment bolt 78.

Disposed within the support carriage 74 are bearings 82*a, b* which journal the shaft 60 for rotation about axis B. The bearings 82*a, b* are in turn mounted to a support panel 84. The panel 84 includes a plurality of threaded sleeves 86 which are likewise supported on the vertical support pillars 76. Offset adjustment bolts 88 are in turn disposed between the frame 80 and threaded sleeves 86. Accordingly, rotation of the offset adjustment bolts 88 displaces the support carriage 74, its frame 80 and the journaled shaft 60 to displace the axis B relative to the axis A. For example, the offset position of the axis B may be adjusted to be collinear with the first axis A or may be offset as shown in FIG. 1. The offset provided between the axes A, B induces a radial component to the centrifugal forces induced by rotation of the first and second rotors 34, 46 and the rolling or scrubbing forces induced by the relative rotation between the first and second rotors 34, 50. It has been found that for certain types of rocks and the desired output, that an offset can advantageously crush the rocks 18. Alternatively, the axes A and B may be aligned.

To rotate the shaft 60, the support carriage 74 also mounts a motor 90 coupled to the shaft 64 rotation as by a chain 92 and sprocket 94. The motor 90, like the first motor 40, may be variable speed and adapted to, for example, rotate the shaft 60 and second rotor 46 at between 60 and 180 rpm.

With reference to FIGS. 1, 6 and 7, the first rotor 34 is rotated in a counterclockwise direction whereas the second rotor 46 is rotated in a clockwise direction to provide a maximum of the relative speeds between the first and second crushing surfaces 34, 50. The first rotor 26 may not include the shoes 36 and the first motor 40 may be reversible whereby the direction as well as the relative speeds between the rotation of the first and second rotors 34, 50 may be altered. That is, the first rotor 26 may be rotated in the same clockwise direction as the second rotor 46 or in a counter-direction.

With the components of the device 10 described above, its operation will now be set forth.

By adjusting the vertical adjustment bolt 78, the space at the nip 52 may be adjusted taking into account several factors. One factor is that the space at the entrance 96 of the nip 96 must be sufficiently large to accept the largest size of rock 18 fed into the device 10. The second consideration is that at the discharge 98 of the nip 50, the spacing between the first and second crushing surfaces 34, 50 can be no greater than the maximum size of crushed material 20 to be discharged from the device 10. That is, if chips having a size of approximately one-half inch are desired, the first and second rotors 26, 46 should be adjusted such that the discharge 98 of the nip 52 is approximately one-half inch. If crushed sand is desired, then the discharge 98 should be made smaller to adequately crush the rocks 18 into the smaller size. It is to be understood, depending upon the nature of the rocks fed into the device 10 that the angle of the annular, conical ring 48 defining the second crushing surface 50 may be altered so as to receive the rocks 18. It has been found that an angle formed with the first crushing surface 34 of approximately 9° to 10° provides for satisfactory crushing of the rocks.

After the nip 52 has been adjusted, the offset between the first and second axis A, B is selected and set. Preferably the maximum offset permitted is only to the degree that the perimeter of the second rotor 46 aligns with the perimeter of the first rotor 40 as shown in FIG. 1. Thereafter, the first and second rotors 26, 46 are engaged by their first and second motors 40, 90 and rotation is begun. When the first and second rotors 26, 46 have reached their speeds, rocks 18 are fed into the feed port 14 whereupon they fall into the bin 70. Centrifugal force caused by rotation of the second rotor 46 urges the rocks 18 to the outside of the bin 70. Gravity urges the rocks downwardly in the bin to be received into the scoops 66 and feed openings 62 and into the crushing chamber 58. The centrifugal force on the rocks 18 in the crushing chamber, along with any axial loading induced by the scoops 66 and any forces imposed by the directing surface 38 on the shoes 36 urge the rocks 18 from the crushing chamber 38 through the annular nip 52 for crushing between the first and second crushing surfaces 34, 50. As stated above, the rocks are crushed due to the loads of the first and second crushing surfaces 34, 50 imposed due to the centrifugal force on the rocks 18, the force induced by the scoops 66 and directing surfaces 38 as well as the circumferential buffing or rolling action caused by the relative rotation between the first and second rotors 34, 46. The pinching between the first and second crushing surfaces 34, 50 created by the nip 52 crushes the rocks 18 into the crushed material 20. The crushed material 20, induced by centrifugal force, is ejected outwardly to the housing 12 where it falls by gravity for discharge therefrom.

Figure 8:
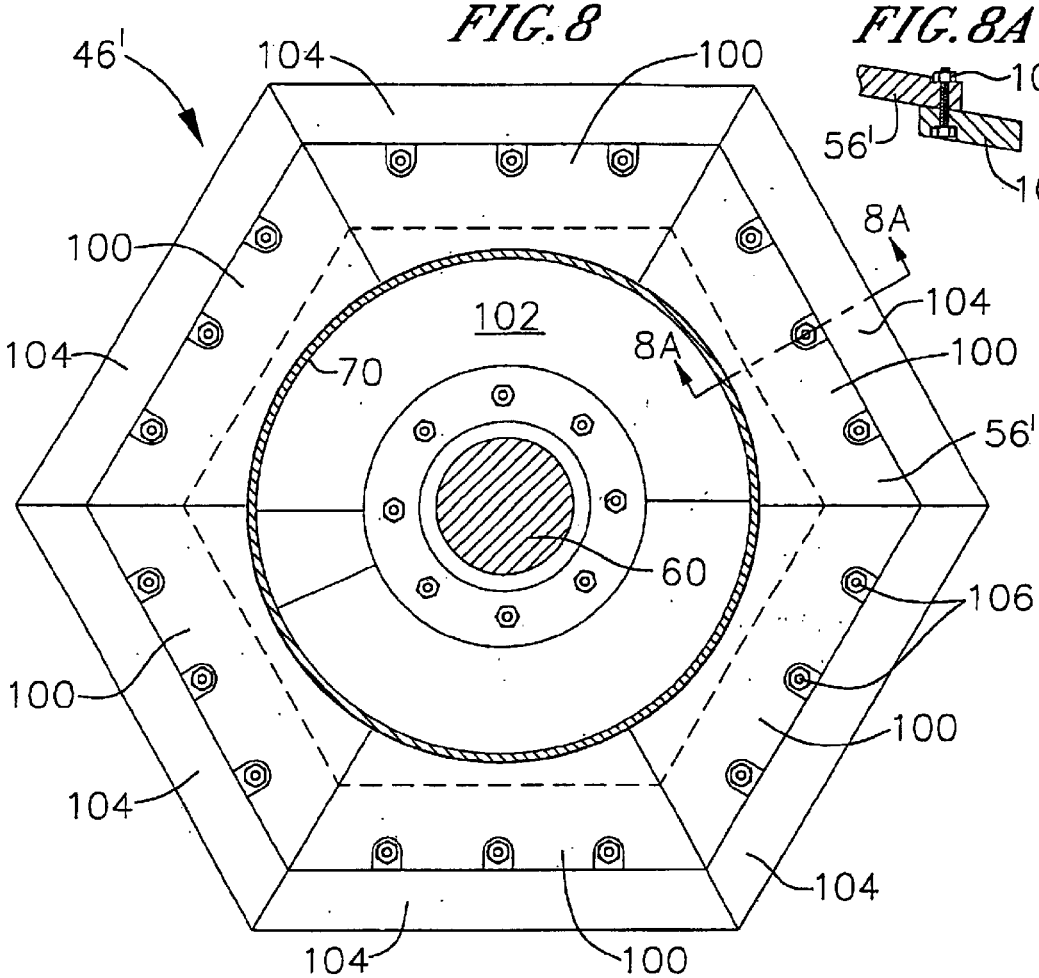
(Prior Art) FIG. 8
FIG. 8 is a top plan view of a further embodiment of the second rotor according to the prior art.
Figure 8A:
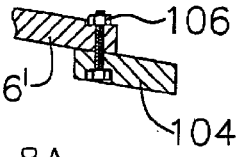
(Prior Art) FIG. 8A
FIG. 8A is a partial section view of the second rotor according to the prior art of FIG. 8 taken along line 8A—8A of FIG. 8.
Figure 9:
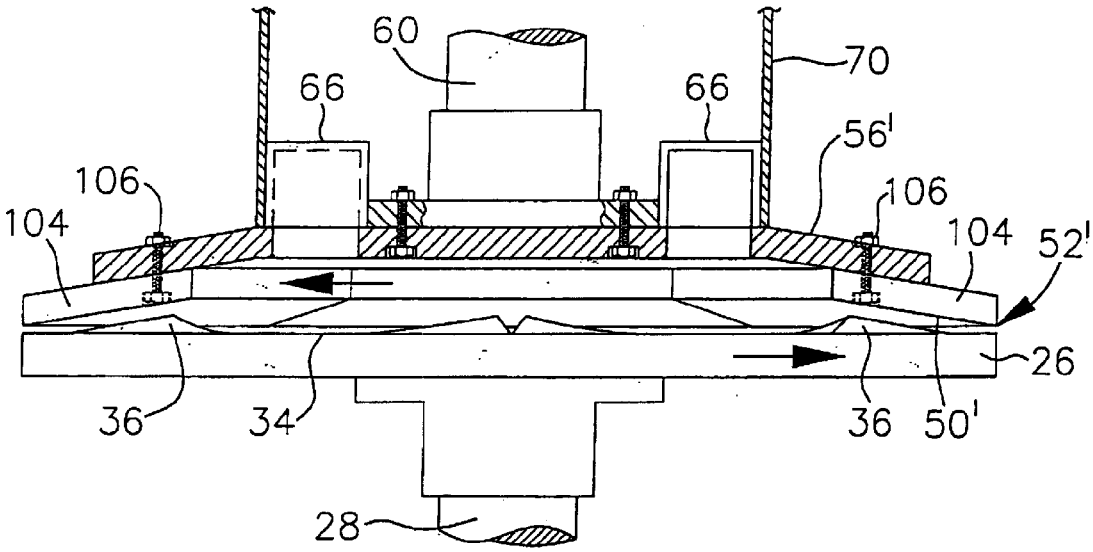
FIG. 9 (Prior Art)
FIG. 9 is a partial section view of the device according to the prior art incorporating the second rotor of FIG. 8.

Turning to FIGS. 8 through 9, a further embodiment according to the prior art is shown and particularly pertinent to the present invention. Like components bear the same reference numerals.

According to this embodiment, the second rotor 46' includes a hexagonal top plate 56' defining six depending wings 100 which extend downwardly at an angle of between 9° and 10° from a circular and planar center 102. The perimeter of the circular center 102 corresponds with the diameter of the bin 70 to define the bottom thereof. Scoops 66 may be provided for the second rotor 46'.

To define the second crushing surface 50', the second rotor 46' includes secured to each of the wings 100 replaceable crushing plates 104 which are adapted to conform to the overall hexagonal shape of the second rotor 46'. Fasteners 106 secure each of the crushing plates 104 to the corresponding wings 100 and accordingly it is to be understood that by removing the fasteners 106, the crushing plates 104 can be replaced for the second rotor 46'. Each of the crushing plates 104 is secured to their corresponding wings 100 to depend again, preferably, an angle of between 9° to 10° relative to the first crushing surface 34. Accordingly, it is to be understood that the perimeter of the second rotor 46' is of a varying radius or diameter from axis A and defines a non-circular nip 52' for the device 10. As is also to be understood, upon rotation of the shaft 60, and by virtue of the variable perimeter of the second rotor 46', that rocks trapped in the nip 52' will be urged to move, relative to the perimeter of the rotors, radially inwardly and outwardly as the second rotor 46' rotates. Furthermore, the angles defined at the joinder of adjacent crushing plates 104 act substantially as a funnel to funnel rocks between the crushing plates 104 of the second crushing surface 50' for crushing thereof. It has been found that by using the hexagonal second rotor 46' as shown in FIG. 8, efficient crushing of rock 18 is obtained.

Figure 10:
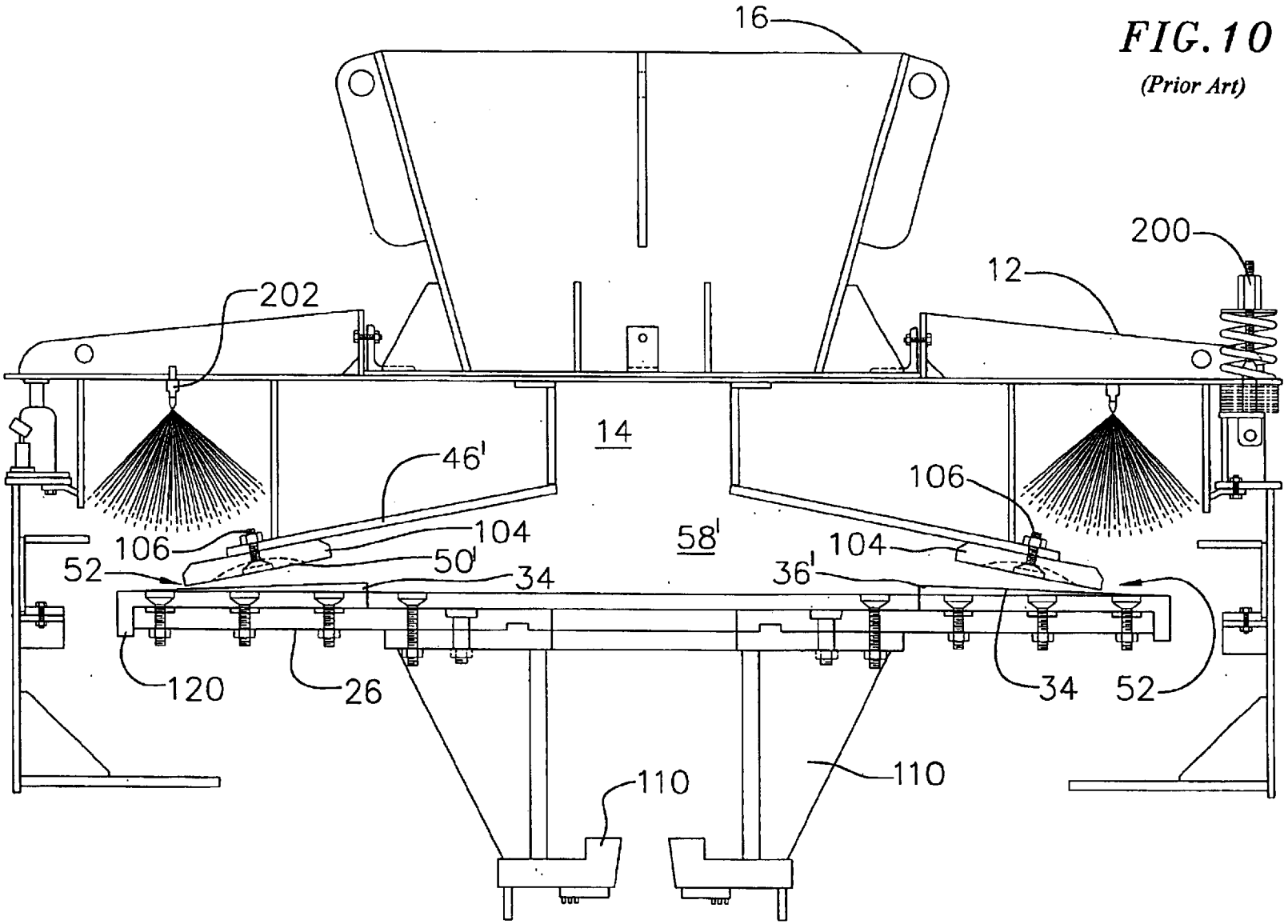
FIG. 10 (Prior Art)
FIG. 10 is a side section view of a further embodiment of a crusher according to the prior art.
Figure 11:
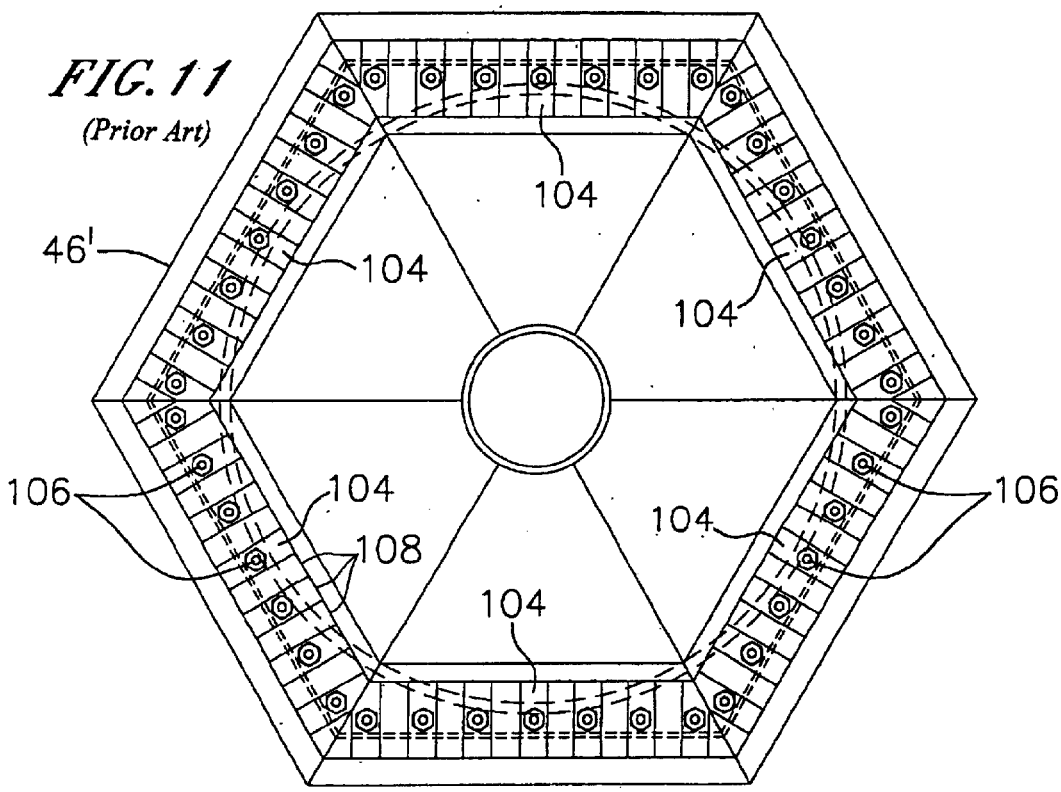
FIG. 11 (Prior Art)
FIG. 11 is a top view of the top plate and first rotor according to the the prior art and the embodiment of FIG. 10.
Figure 12:
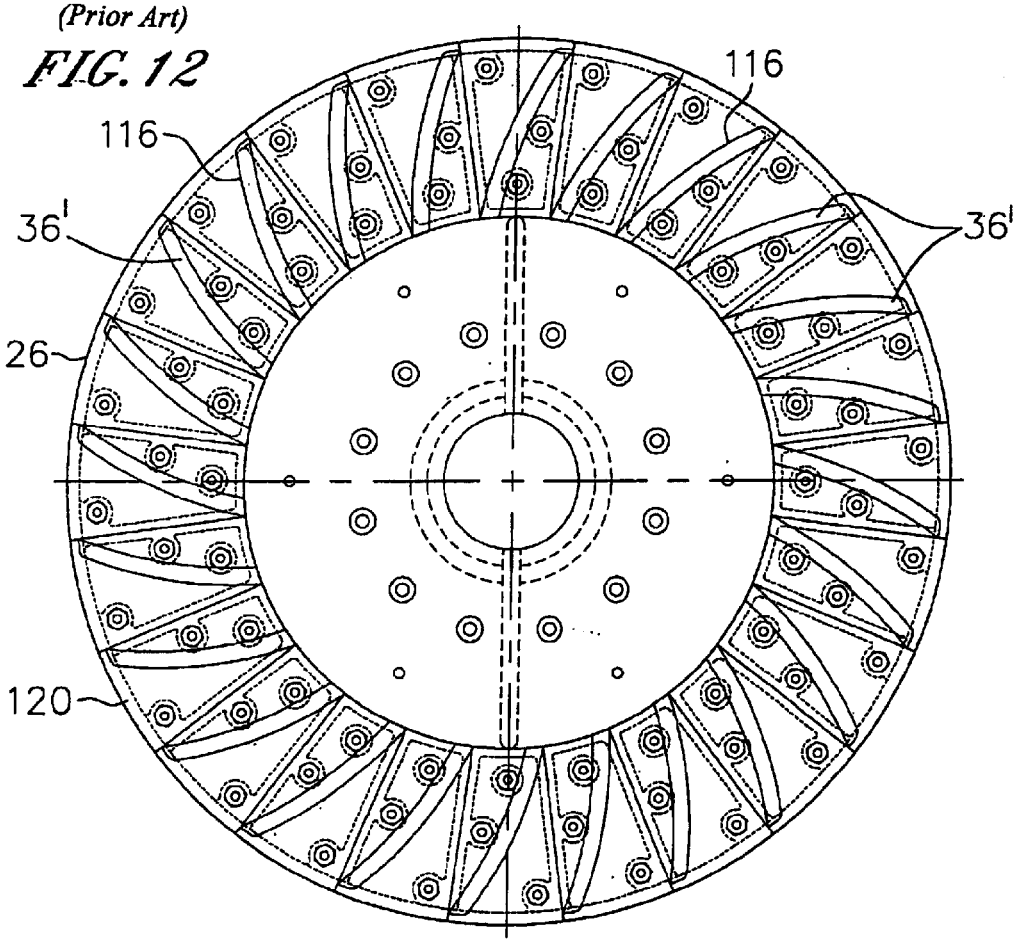
(Prior Art) FIG. 12
FIG. 12 is a top view of the first crushing surface and shoes of the prior art and to the embodiment of FIG. 10.

With reference to FIGS. 10–12 a further embodiment of a crusher according to the prior art is shown. According to this embodiment a funnel 16 is provided on the housing 12 to direct rocks fed into the housing to a feed port 14'.

The feed port 14' directs the rock into the conical crushing chamber 58' defined between a second rotor 46', which is preferably fixed but may be free wheeling or driven for rotation, and a rotatable first rotor 26. As with the previous embodiment, the second rotor 46' has radially projecting wings each of which mounts a crushing plate 104. The crushing plates 104 may each consist of single plate or be fashioned from a plurality of sub-plates 108 secured to the wing by fasteners 106. As shown, the second rotor 46' and crushing plates 104 define a hexagonal second crushing surface 50' and nip 52 between the crushing plates 104 and the first crushing surface 34. The crushing plates 104 are mated at adjoining sides to provide a continuous, hexagonal, second crushing surface 50'.

As can be appreciated the crushing plates 104 are substantially planar and thus can easily be manufactured and replaced. At the second crushing surface 50' the fasteners 106 are recessed to prevent damage thereto.

The first rotor 26 is driven by a first motor 40 (not shown in FIGS. 10–12) for rotation. Supporting struts 110 are coupled between the first rotor 26 and a shaft plate 112 which is, in turn, coupled to the first motor, provides for the rotation of the first rotor 26.

To direct the rock fed into the crushing chamber 58 the first rotor 26 includes a plurality of shoes 36' as shown in FIG. 12. Each shoe 36' has, in plan view, an arcuate leading edge 116 which also slopes downwardly toward the periphery of the second rotor 46', inside out as shown in FIG. 10. A circular fastening plate 120 is adapted to secure the shoes 36' to the first rotor 26. Each shoe 36' urges the rocks outwardly into the nip 52 between the first and second rotors 26, 46' and the leading edge 116 in cooperation with the second rotor 46' and the crushing plates 104 thereof provides a varying nip 52 to crush the rocks.

The hexagonal shape of the second crushing surface 50' and nip 52 provide for a nip 52 whose position varies radially with respect to the axis of the first rotor 26. Thus when the first rotor 26 is rotated the rocks are subject to a radial scrubbing action as a variable radial distance to the nip 52 is provided by the polygonal shape of the second crushing surface 50'. In that the crushing plates 104 are angled downwardly to the nip 52, a further compaction force is imposed on the rocks.

Still further the forces imposed by the shoes 36 along with centrifugal forces impose a radial force upon the rocks to direct them into the nip 52. The aforesaid forces contribute to the efficient crushing of the rocks.

Further the sloping of the leading edges 116 of the shoes 36 provide with the second crushing surface 50' a taper to the nip 52 to crush rocks.

With reference to FIG. 10, the space defined by the nip 52 may be adjusted by adjusting struts 200. Use of these struts 200 raises the second rotor 46' relative to the first rotor 26 to adjust the nip 52 to the desired spacing.

To control dust, spry nozzles 202 may be provided about the periphery of the nip 52.

It is to be understood that while the second rotor 46' may be circular or hexagonal as described above, it could also be triangular, square or oblong to provide a variable radius to induce the rocks to move inwardly and outwardly for crushing thereof.

Figures 13A, 13B, 13C, 13D:
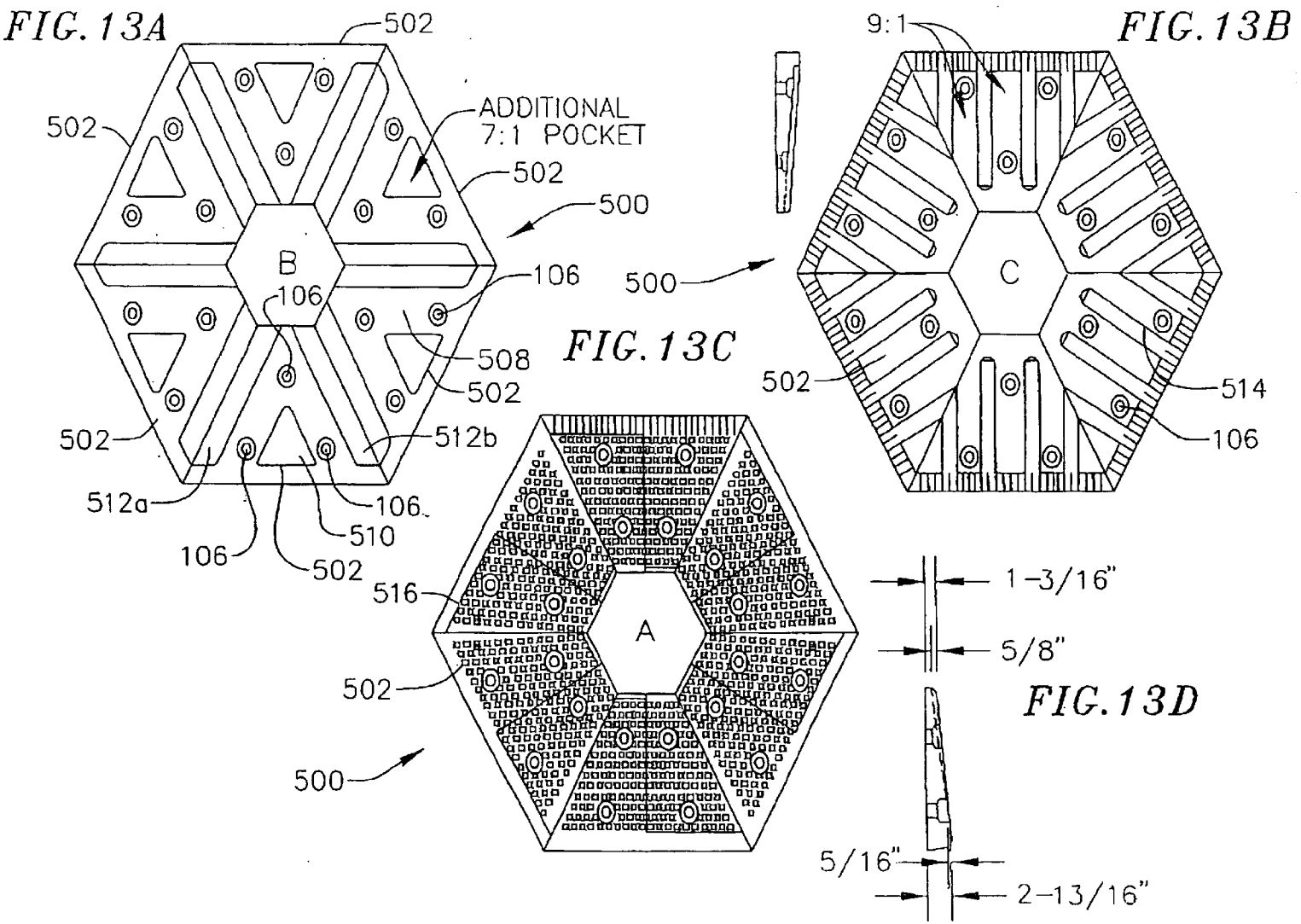
FIGS. 13A–D show several embodiments of the underside of the top rotor and its plates according to the present invention.

Turning to FIGS. 13A–D several embodiments of second rotor 500 and second crushing surface 50 according to the present invention are shown. With reference to FIG. 13A, the second rotor 500 includes a plurality of crushing plates 502 secured to wings 100 (FIG. 9) by fasteners 106. As shown, the shape of the second rotor 500 and plates 502 may be polygonal such as defining a hexagon.

To enhance crushing and agitation of the material being crushed in advance of entry into the nip, each plate 502 may include a plurality of protuberances or projections defined as a triangular ridge 508 formed on the plate 502 by a triangular pocket 510 and side recesses 512*a, b.*

With reference to FIG. 13B, each plate 502 is seen to include the protuberances as radially extending ridges 514. In FIG. 13C, the protuberances are embodied as patterns of studs 516. FIG. 13D shows a side view of a plate 502 and its taper to the nip 52 as well as the openings for attaching the plate 502 by fasteners 106.

It is believed that the protuberances enhance crushing by agitating and providing initial crushing and abrasive action on the material in advance to the material entering the nip 52 between the first and second crushing surfaces. Further the protuberances are believed to urge the material to the nip 52.

The plates 502 are arranged to angle and converge toward the first rotor at the nip 52.

Figure 14:
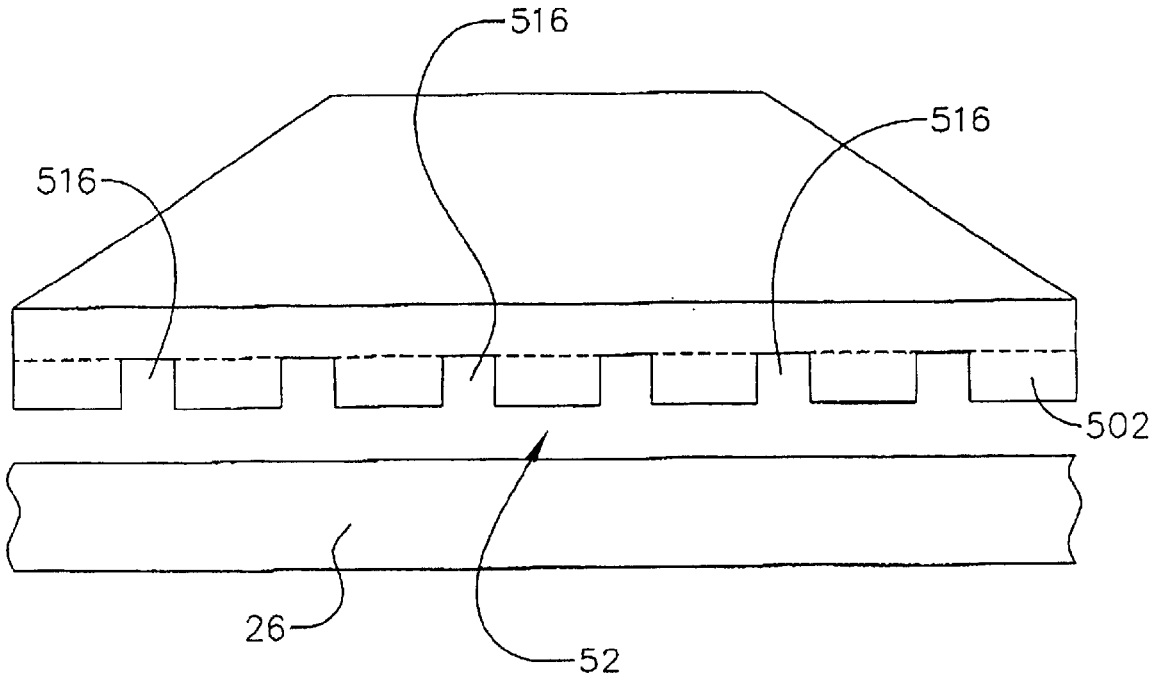
FIG. 14 shows an end view of a plate for the second rotor, channels and the nip between the first and second crushing surfaces.

With reference to FIGS. 13B and 14, to provide ports for additional ejection of the crushed material through the nip 52, the edges of the plates 502 defining the second crushing surface 50 includes a plurality of radial channels 516 which extend through the nip 52. Preferably the channels 516 have a longitudinal dimension to extend into and merge with the crushing surfaces of the plates 502 and a lateral dimension comparable with the spacing of the nip 52. Crushed fines in the crushing camber and proximate the nip 52 are ejected from the crusher through the nip 52 and channels 516. Further, the side edges of the channels 516 provide further abrasion on the material for crushing thereof.

The channels 516 may be provided on the second rotor 500, first rotor 26 or a combination thereof. Further the channels 516 may be provided in addition to the protuberances as suggested in FIG. 13B.

Figure 15A:
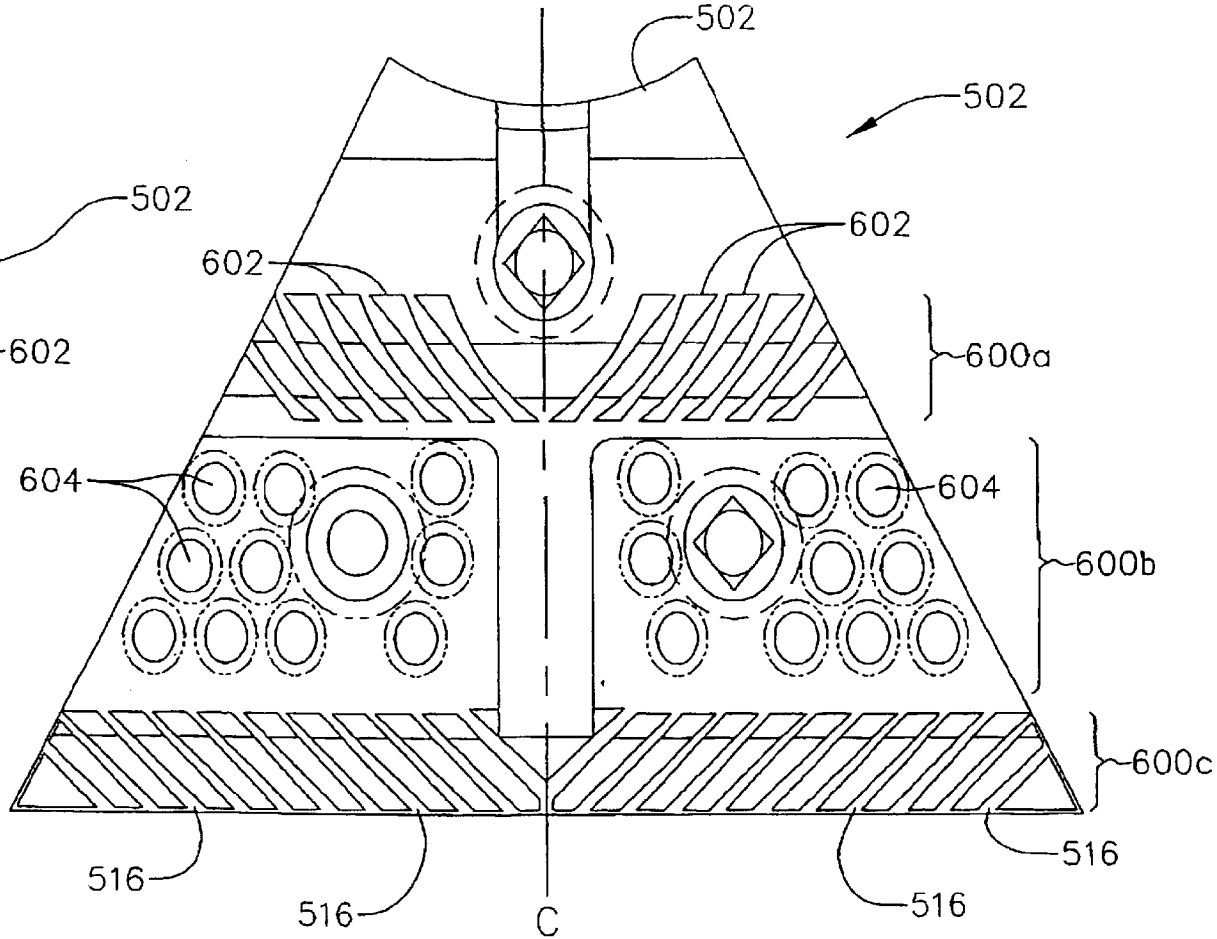
FIGS. 15A and B show a plan and end view of a second rotor crushing plate according to the present invention

Turning to FIGS. 15A and B, there is shown a further embodiment of a plate 502 according to the present invention. According to this embodiment, the face of the plate 502 is presented as areas 600*a–c* having different configurations. In area 600*a* there are provided a plurality of projections 602 which are angled relative to a radial C. These projections are elongated and are tapered outwardly from the face of the plate 502 as suggested in FIG. 15B. As is also shown in FIG. 15A the projections 602 are oppositely angled with respect to the axis C.

Area 600*b* includes a plurality of projecting nobs 604 which also project form the face of the plate 502. Area 600*c* includes a plurality of channels 516 oppositely angled with respect to the axis C and disposed to extend through the nip 52. Preferably, the angling of the channels is such that, with reference to the channels 516 to the right of FIG. 15A would be angled into the direction of counterclockwise rotation of the second rotor 46 whereas those on the left side are angled into the direction of clockwise rotation. Thus, those channels 516 directed for counterclockwise rotation would be disposed to offer primary ejection of the crushed material in that they are directed into the direction of rotation. Conversely, those channels disposed for clockwise rotation would offer the primary ejection for crushed material when the second rotor 46 is rotated in a clockwise rotation.

Further, according to the embodiment of FIG. 15A, B the second rotor 56 (and first rotor 26, may be rotated in both clockwise and counterclockwise directions. By occasionally reversing rotation, it is believed that wear can be more evenly distributed to the plates and crushing surfaces. The angling of the projections 602 and channels 516 accommodates the reversing of rotation.

Figure 15B:
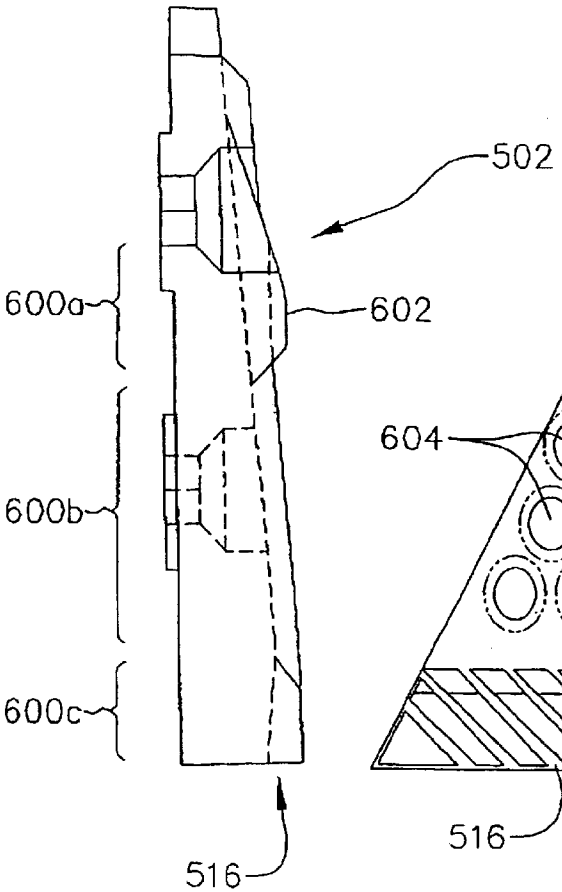

The channels 516 may also taper in increase in depth and width into the face toward the perimeter thereof (FIG. 15B).

Holes 606 through the plate 502 provide for connection to the wings by suitable fasteners as described above.

Figures 16A, 16B, 16C, 16D:
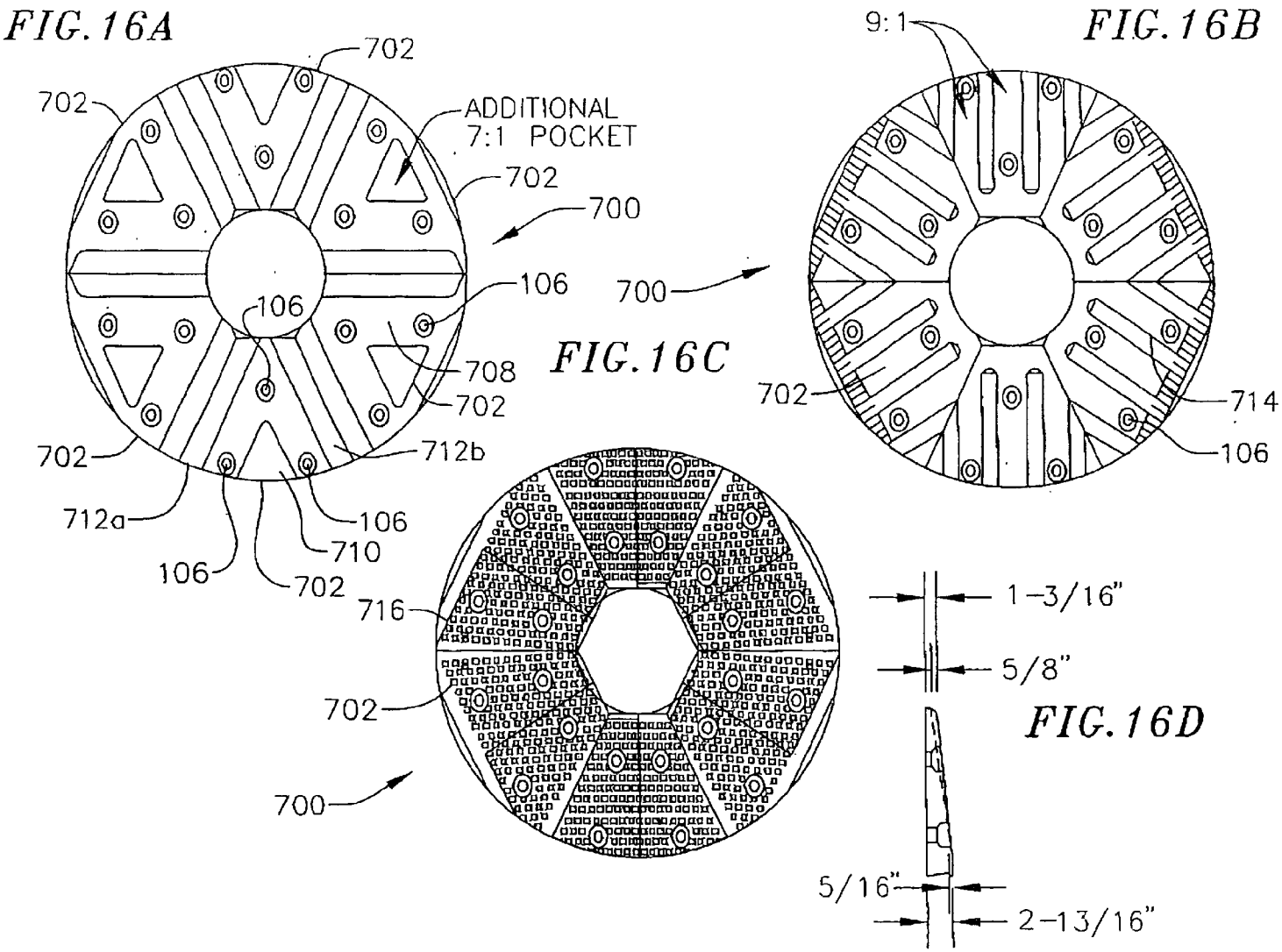
FIGS. 16A–D show several embodiments of the underside of the top rotor and its plates according to the present invention.

Turning to FIGS. 16A–D several embodiments of first rotor 700 and first crushing surface 70 according to the present invention are shown. With reference to FIG. 16A, the first rotor 700 includes a plurality of crushing plates 702 secured to wings 100 (FIG. 9) by fasteners 106. As shown, the shape of the first rotor 700 and plates 702 may be polygonal such as defining a hexagon.

To enhance crushing and agitation of the material being crushed in advance of entry into the nip, each plate 702 may include a plurality of protuberances or projections defined as a triangular ridge 708 formed on the plate 702 by a triangular pocket 710 and side recesses 712*a, b.*

With reference to FIG. 16B, each plate 702 is seen to include the protuberances as radially extending ridges 714. In FIG. 16C, the protuberances are embodied as patterns of studs 716. FIG. 16D shows a side view of a plate 702 and its taper to the nip 52 as well as the openings for attaching the plate 702 by fasteners 106.

It is believed that the protuberances enhance crushing by agitating and providing initial crushing and abrasive action on the material in advance to the material entering the nip 52 between the first and second crushing surfaces. Further the protuberances are believed to urge the material to the nip 52.

The plates 502 are arranged to angle and converge toward the first rotor at the nip 52.

Figure 17:
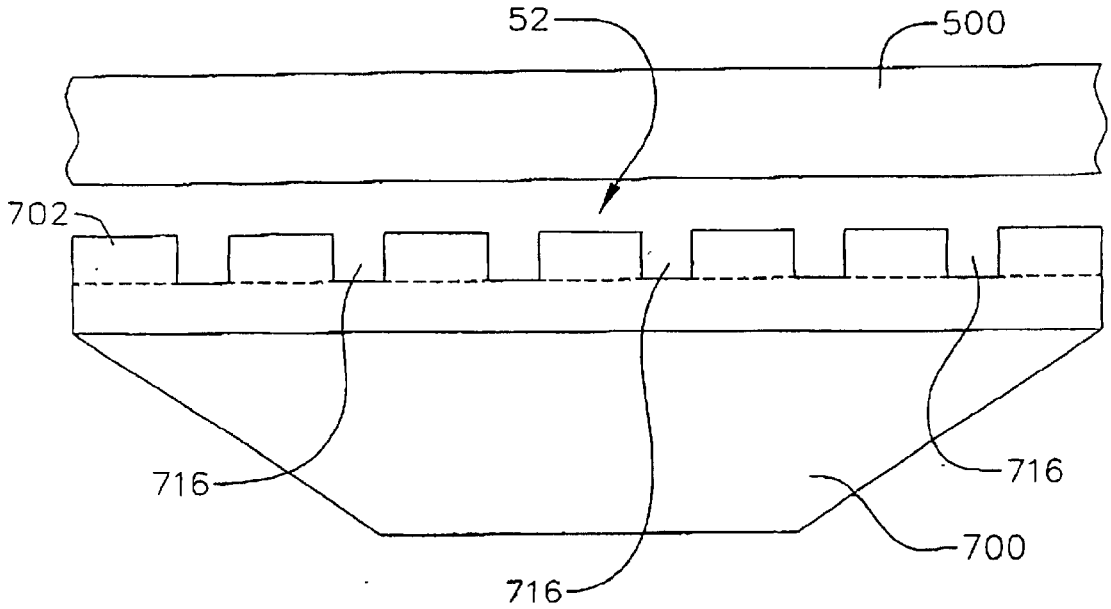
FIG. 17 shows an end view of a plate for the second rotor, channels and the nip between the first and second crushing surfaces.

With reference to FIGS. 16B and 17, to provide ports for additional ejection of the crushed material through the nip 52, the edges of the plates 702 defining the first crushing surface 50 includes a plurality of radial channels 716 which extend through the nip 52. Preferably the channels 716 have a longitudinal dimension to extend into and merge with the crushing surfaces of the plates 702 and a lateral dimension comparable with the spacing of the nip 52. Crushed fines in the crushing camber and proximate the nip 52 are ejected from the crusher through the nip 52 and channels 716. Further, the side edges of the channels 716 provide further abrasion on the material for crushing thereof.

The channels 716 may be provided on the second rotor 500, first rotor 700 or a combination thereof. Further the channels 716 may be provided in addition to the protuberances as suggested in FIG. 16B.

Figure 18A:
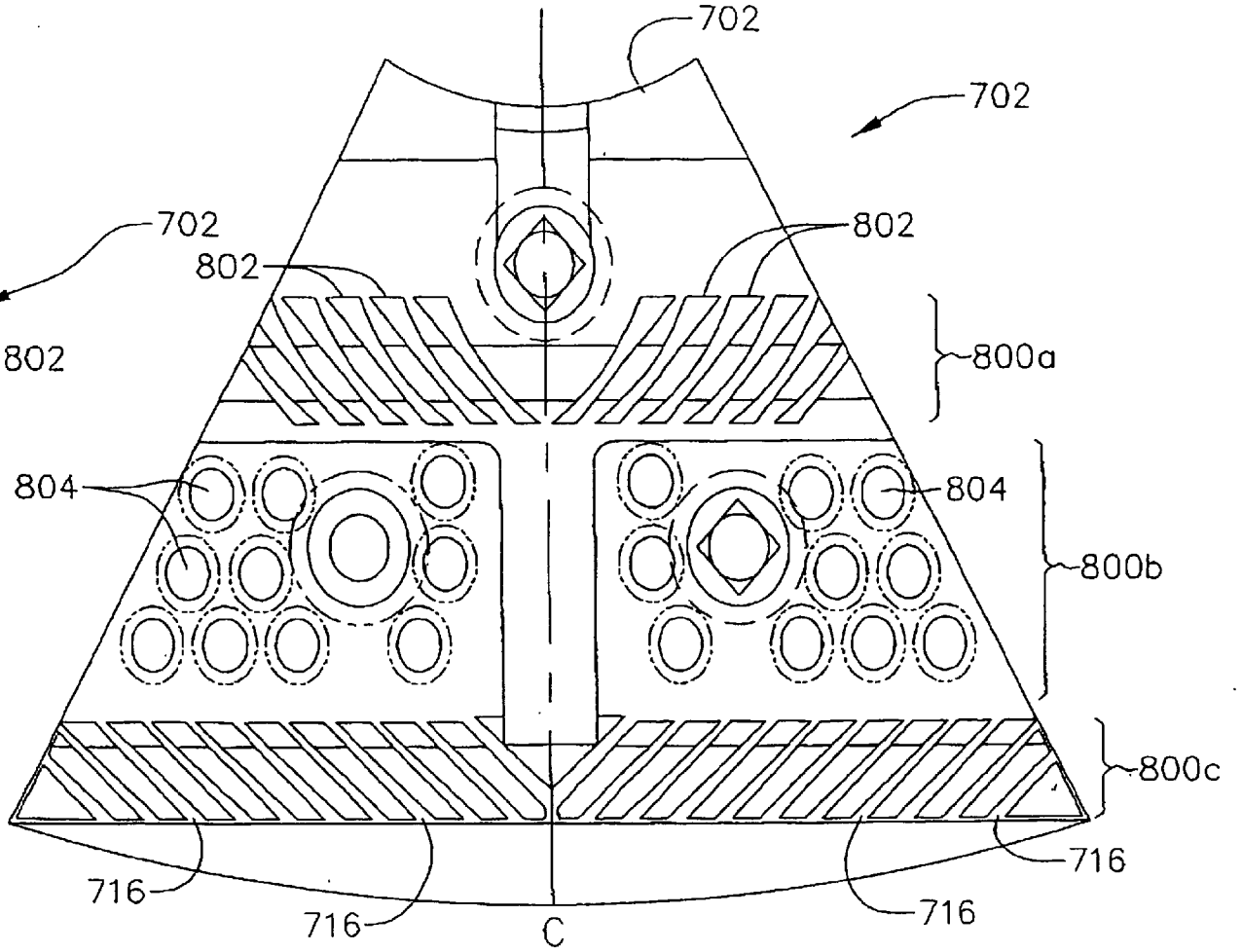
FIGS. 18A and B show a plan and end view of a second rotor crushing plate according to the present invention.

Turning to FIGS. 18A and B, there is shown a further embodiment of a plate 702 according to the present invention. According to this embodiment, the face of the plate 702 is presented as areas 800*a–c* having different configurations. In area 800*a* there are provided a plurality of projections 802 which are angled relative to a radius C. These projections are elongated and are tapered outwardly from the face of the plate 702 as suggested in FIG. 18B. As is also shown in FIG. 18A the projections 802 are oppositely angled with respect to the axis C.

Area 800*b* includes a plurality of projecting nobs 804 which also project form the face of the plate 702. Area 800*c* includes a plurality of channels 716 oppositely angled with respect to the axis C and disposed to extend through the nip 52. Preferably, the angling of the channels is such that, with reference to the channels 716 to the right of FIG. 18A would be angled into the direction of counterclockwise rotation of the first rotor 46 whereas those on the left side are angled into the direction of clockwise rotation. Thus, those channels 716 directed for counterclockwise rotation would be disposed to offer primary ejection of the crushed material in that they are directed into the direction of rotation. Conversely, those channels disposed for clockwise rotation would offer the primary ejection for crushed material when the first rotor 46 is rotated in a clockwise rotation.

Further, according to the embodiment of FIG. 18A and B the second rotor 500 and first rotor 700, may be rotated in both clockwise and counterclockwise directions. By occasionally reversing rotation, it is believed that wear can be more evenly distributed to the plates and crushing surfaces. The angling of the projections 802 and channels 716 accommodates the reversing of rotation.

Figure 18B:
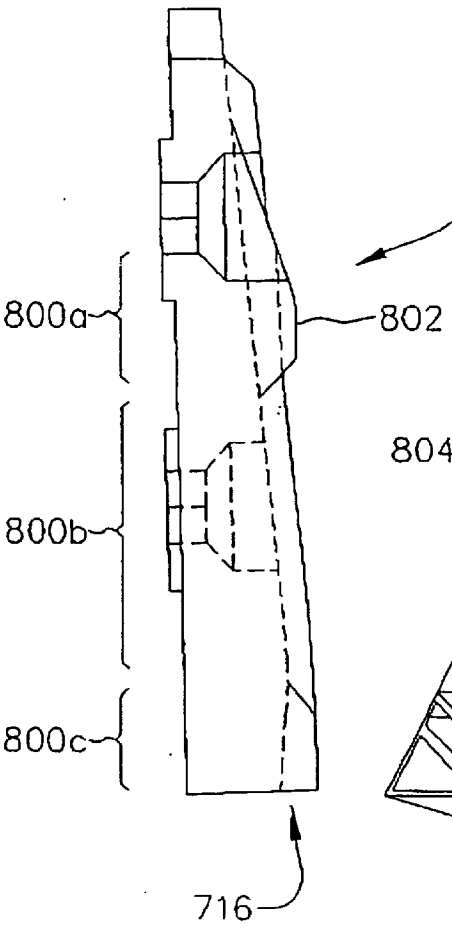

The channels 716 may also taper in increase in depth and width into the face toward the perimeter thereof (FIG. 18B).

Holes 806 through the plate 702 provide for connection to the wings by suitable fasteners as described above.

While I have described certain embodiments of the present invention, it is to be understood that it is subject to many modifications and changes without departing from the spirit and scope of the claims. For example, the channels described herein could be disposed on the first rotor as well.

I claim:

1. A device for crushing material comprising:

a housing having a feed port to receive material into the housing to be crushed and a discharge for crushed material;

a first rotor disposed in the housing having a first axis and defining a first crushing surface, wherein said first rotor is circular defining a circular first crushing surface, each arc segment of the circle defined by a substantially arcuate plate;

a second rotor disposed in the housing having a second axis, said second rotor including an axial cavity to pass material, a face defining a second crushing surface adapted to be spaced from the first crushing surface to define a circumferential nip for crushing material between said first and second crushing surfaces, said crushed material ejected at said nip, one of said first or second crushing surfaces including channels extending outwardly through said nip to eject said crushed material; and means for rotating the first rotor to centrifugally direct material between said nip for crushing thereof, said crushed material ejected from said nip and channels and discharged from said housing discharge.

2. The device of claim 1 wherein said channels are defined on at least one of said plates to extend through said first crushing surface.

3. The device of claim 1 wherein said plates are disposed at an angle relative to said axis to converge to said nip.

4. The device of claim 3 wherein each plate includes a plurality of projections to crush and agitate said material in advance of said material entering said nip.

5. The device of claim 4 wherein said projections define ridges extending toward said nip.

6. The device of claim 4 wherein said projections define studs.

7. The device of claim 1 wherein each arcuate plate defining said first crushing surface includes channels disposed to extend through said nip, a plurality of projecting studs and a plurality of projecting ridges.

8. A device for crushing material comprising:

a housing having a feed port to receive material into the housing to be crushed and a discharge for crushed material;

a first rotor disposed in the housing having a first axis and defining a first crushing surface, wherein said first rotor is circular defining a circular first crushing surface, each arc segment of the circle defined by a substantially arcuate plate;

a second rotor disposed in the housing having a second axis, said second rotor including an axial cavity to pass material, a face defining a second crushing surface adapted to be spaced from the first crushing surface to define a circumferential nip for crushing material between said first and second crushing surfaces, said crushed material ejected at said nip, one of said first or second crushing surfaces including channels extending outwardly through said nip to eject said crushed material, wherein said channels are disposed at said nip and directed at an angle relative the radius of said axis of the first rotor; and means for rotating the first rotor to centrifugally direct material between said nip for crushing thereof, said crushed material ejected from said nip and channels and discharged from said housing discharge.

9. The device of claim 8 comprising said channels directed at opposing angles relative to said axis and including means for selectively rotating said first rotor in clockwise and counterclockwise directions.

10. A device for crushing material comprising:

a housing having a feed port to receive material into the housing to be crushed and a discharge for crushed material;

a first rotor disposed in the housing having a first axis and defining a first crushing surface, wherein said first rotor is circular defining a circular first crushing surface, each arc segment of the circle defined by a substantially arcuate plate;

a second rotor disposed in the housing having a second axis, said second rotor including an axial cavity to pass rocks, a face defining a second crushing surface, said second crushing surface being polygonal to have a variable radial distance from said second axis and adapted to be spaced from the first crushing surface to define a polygonal, circumferential nip for crushing rocks between said first and second crushing surfaces;

a plurality of projections and channels on said second crushing surface; and means for rotating the first rotor to centrifugally direct material between said nip for crushing thereof, said crushed material ejected from said nip and channels and discharged from said housing discharge.

11. The device of claim 10 wherein said plates are disposed at an angle relative to said axis to converge to said nip.

12. The device of claim 11 wherein each plate includes a plurality of projections.

13. The device of claim 12 wherein said projections define ridges extending toward said nip.

14. The device of claim 12 wherein said projections define studs.

15. A device for crushing material comprising:

a housing having a feed port to receive material into the housing to be crushed and a discharge for crushed material;

a first rotor disposed in the housing having a first axis and defining a first crushing surface and channels at said first crushing surface to eject crushed material;

a second rotor disposed in the housing having a second axis, said second rotor including an axial cavity to pass rocks, a face defining a second crushing surface, said second crushing surface being polygonal to have a variable radial distance from said second axis and adapted to be spaced from the first crushing surface to define a polygonal, circumferential nip for crushing rocks between said first and second crushing surfaces;

a plurality of projections and channels on said second crushing surface; and means for rotating the first rotor to centrifugally direct material between said nip for crushing thereof, said crushed material ejected from said nip and channels and discharged from said housing discharge.

* * * * *